US005385100A

United States Patent [19]

Corzine et al.

[11] Patent Number: 5,385,100

[45] Date of Patent: Jan. 31, 1995

[54] UPSET JACKETED BULLET

[75] Inventors: Alan J. Corzine, Marine; Jack D. Dippold, Edwardsville, both of Ill.; David K. Schluckebier, Cabot, Ark.

[73] Assignee: Olin Corporation, East Alton, Ill.

[21] Appl. No.: 157,353

[22] Filed: Nov. 19, 1993

Related U.S. Application Data

[60] Continuation of Ser. No. 906,187, Jun. 29, 1992, abandoned, which is a division of Ser. No. 863,647, Apr. 2, 1992, Pat. No. 5,208,424, which is a continuation-in-part of Ser. No. 679,475, Apr. 2, 1991, Pat. No. 5,101,732.

[51] Int. Cl.[6] ..... F42B 12/34

[52] U.S. Cl. ..... 102/507

[58] Field of Search ..... 102/507–510, 102/514–517

[56] References Cited

U.S. PATENT DOCUMENTS

| | | | |
|---|---|---|---|
| 2,327,950 | 8/1943 | Whipple | 102/507 |
| 3,120,188 | 2/1964 | Kreuzer | 102/514 |
| 3,157,137 | 4/1963 | Burns, Jr. | 102/91 |
| 3,349,711 | 10/1967 | Darigo et al. | 102/91 |
| 4,044,685 | 8/1977 | Avcin | 102/508 |
| 4,550,662 | 11/1985 | Burczynski | 102/509 |
| 4,610,061 | 6/1985 | Halverson | 102/509 |
| 5,101,732 | 4/1992 | Schluckebier | 102/509 |
| 5,208,424 | 5/1993 | Schluckebier et al. | 102/509 |

FOREIGN PATENT DOCUMENTS

| | | | |
|---|---|---|---|
| 17996 | of 1898 | United Kingdom | 102/514 |
| 4426 | 4/1989 | United Kingdom | 102/508 |

*Primary Examiner*—Harold J. Tudor
*Attorney, Agent, or Firm*—Gregory S. Rosenblatt

[57] ABSTRACT

A full metal jacket hollow point bullet is disclosed which has a portion of the jacket extending within the hollow open front end of the bullet. The portion of the jacket in the hollow front end has a plurality of radial slits and reinforced pointed prongs therebetween. A rearwardly extending completely empty blind bore extends from the tips of the prongs axially rearwardly into the bullet core. The base of each of the prongs is reinforced at the mouth of the front end by a fillet on each side between the ogive portion of the jacket and the base of the prong in the hollow front end. These prongs project generally radially outward upon upset of the bullet in soft tissue after passing through barrier materials such as clothing and deer hide.

The jacket has a coating of copper oxide on its inner and outer surfaces which bonds the soft lead core to the jacket and minimizes lead wash.

7 Claims, 4 Drawing Sheets

UPSET JACKETED BULLET

CROSS-REFERENCE TO RELATED APPLICATIONS

This patent application is a continuation of U.S. patent application Ser. No. 07/906,187, filed Jun. 29, 1992 (now abandoned) which is a division of U.S. patent application Ser. No. 07/863,647, filed Apr. 2, 1992 (now U.S. Pat. No. 5,208,424) which in turn is a continuation-in-part of U.S. patent application Ser. No. 07/679,475, filed Apr. 2, 1991 (now U.S. Pat. No. 5,101,732).

BACKGROUND OF THE INVENTION

This invention generally relates to bullets and more particularly to a small caliber projectile having a hollow point and a full metal jacket.

Jacketed bullets are well known in the art. The bullet typically is made of a lead alloy and has a jacket typically made of a copper alloy and covers at least part of the ogive and the cylindrical body portions of the bullet. This type of jacketed bullet gives a more controlled expansion in soft body tissue than an unjacketed lead bullet. Further expansion can be obtained upon initial target penetration by providing a hollow in the front end of the bullet. The front end may also be formed with cuts and/or ribs in the jacket or with cuts or ribs in the core within the hollow tip to further control the expansion upon upset of the bullet in soft tissue.

One typical hollow point jacketed bullet is disclosed in U.S. Pat. No. 3,157,137, assigned to the assignee of the present invention. This patent discloses a jacketed bullet with a rosette type of hollow point formed entirely from the open jacket end. Another is U.S. Pat. No. 3,349,711 which has external cuts in the ogive portion of the full metal jacket around the hollow tip. Another example is U.S. Pat. No. 4,550,662. In this patent, the hollow tip is formed with axially extending ribs in the soft metal core.

Another hollow point jacketed bullet, using aluminum for the jacket, is disclosed in U.S. Pat. No. 4,610,061, assigned to the assignee of the present invention. In this patent, the jacket extends only part way into the hollow and partial cuts are made in the jacket at the rim of the hollow point.

All of these bullets provide relatively predictable curling back of the jacket upon upset of the bullet in soft tissue. The petals formed by the jacket segments peeling back curl beyond 180°, folding under the expanding head of the bullet, along the cylindrical portion thereof. Thus the cutting swath in soft tissue is generally determined by the outer diameter of the expanded head of the upset bullet.

Maximum expansion of the head is desirable to maximize hemorrhaging and tissue damage. This maximized expansion maximizes the lethality in game animals. However, if the head expands too much, the bullet will separate into segments which limits the penetration. Accordingly, to obtain significant depth of penetration, the mass of the bullet must remain behind the head.

When a particular projectile is designed for law enforcement use consideration must be given to penetration performance through various barrier layers such as fabric, glass, and sheet metal. These barriers cannot all be accounted for in a single projectile design. To achieve a desired penetration depth after passing through known barriers with a desired upset shape, hollow point bullets are not presently used.

A hollow point bullet is optimized to achieve a desired upset shape following penetration through generally soft material, typically simulated by water or gelatin. If there is a barrier in front of the soft body tissue, such as a layer of sheet metal or a piece of glass, a hollow point bullet will deform immediately thus changing the penetration in the body tissue. However, it would be desirable to have a bullet which would penetrate through known barriers and still upset and expand in a manner that maximizes tissue damage.

SUMMARY OF THE INVENTION

It is an object of the invention to provide a bullet which causes improved tissue damage in soft body tissue without substantial separation of the jacket from the bullet core.

It is another object of the invention to provide a controlled penetration bullet which has an increased effective head diameter upon upset after penetrating through a barrier.

It is another object of the invention to provide a jacketed bullet which produces jacket petals with radially outwardly extending pointed prongs after penetration through clothing barrier materials into soft body tissue.

It is a further object of the invention to provide a jacketed bullet with improved adherence of the jacket to the core.

It is a still further object of the invention to provide a jacketed bullet which, upon upset, produces outwardly curled jacket petals which have curled back portions joining curved radially outwardly extending pointed prongs at a hardened transition region.

The full metal jacketed bullet in accordance with the invention is a generally cylindrical jacketed body with a generally ogival front portion and an open cavity in the front end. The cavity preferably has a tapered front portion and a cylindrical rear portion. The bullet jacket extends over the cavity mouth at a hardened transition region and extends into the tapered front portion of the open cavity in the front end.

The portion of the metal jacket in the cavity has a plurality of spaced axial slits extending through the jacket thickness at the cavity mouth and extending rearwardly toward the central axis so as to form spaced pointed prongs, each directed rearwardly along the cavity wall toward the central axis of the bullet. Each prong has a reinforcing fillet at the the base of each slit, in the transition region at the cavity mouth which reinforces the prong. The cavity has a generally cylindrical axial extension portion extending beyond the tips of the jacket prongs.

These slits and prongs cause the jacket to peel back upon upset in spaced petals. Each petal has a curled portion corresponding to the jacket material formed over the ogive of the bullet, a transition portion corresponding to the jacket material at the mouth of the cavity, and a pointed prong corresponding to the jacket material in the cavity. The transition portion is hardened and has reinforcing ribs or fillets which substantially prevent bending during upset.

The sharp pointed prongs formed at the ends of the petals unfold differently than the curled portions of the petals. The prongs unfold from the transition region. Thus, as the petals unfold, the prongs extend radially outward rather than curling back with the petal material. The result is an upset shape which has the bullet core mushroomed outward over the curled back portion of the jacket petals and outwardly projecting prongs of jacket material radiating outward behind the mushroomed head.

Since the bullet is rotating as it enters soft body tissue of a target animal, the effective head diameter is increased substantially by the prongs. This increases substantially the cutting swath of the upset bullet. In addition, the upset bullet lodged within soft tissue will continue to cause hemorrhaging and further internal damage to the animal as the animal moves due to these outwardly directed prongs. This will hasten the demise of the injured animal and hence increase the lethality of the bullet.

In a preferred embodiment of the invention the cavity includes a central cavity extension. This extension is a generally cylindrical blind bore extending rearwardly from the bottom of the cavity. This extension facilitates proper petal expansion and performance through barrier materials such as heavy clothing and deer hide.

The jacket on the bullet of the invention is also coated with a metal oxide coating which increases the surface adhesion of the lead core to the inner surface of the jacket. This substantially increases the flow of core material outward with formation of the jacket petals upon upset These and other objects, features, and advantages of the present invention will become more apparent upon consideration of the following detailed description when taken in conjunction with the accompanying drawing.

DETAILED DESCRIPTION OF THE INVENTION

Figure 1:
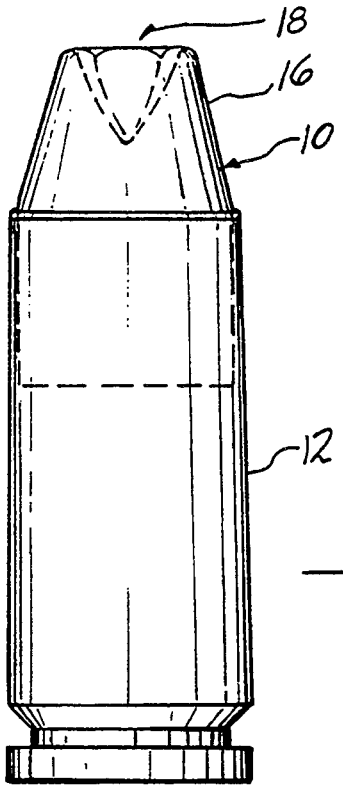
FIG. 1 is a side elevational view of a cartridge containing the bullet in accordance with a first embodiment of the invention.
Figure 2:
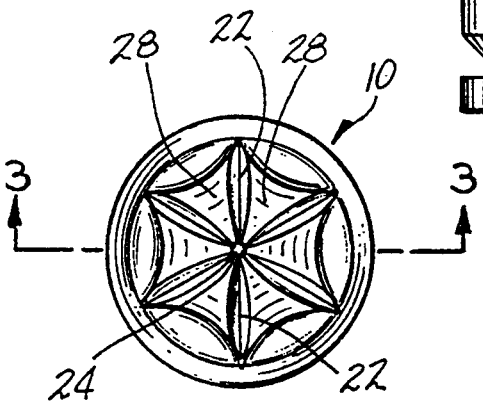
FIG. 2 is an end view of the bullet of the first embodiment of the invention removed from the cartridge case in FIG. 1.
Figure 3:
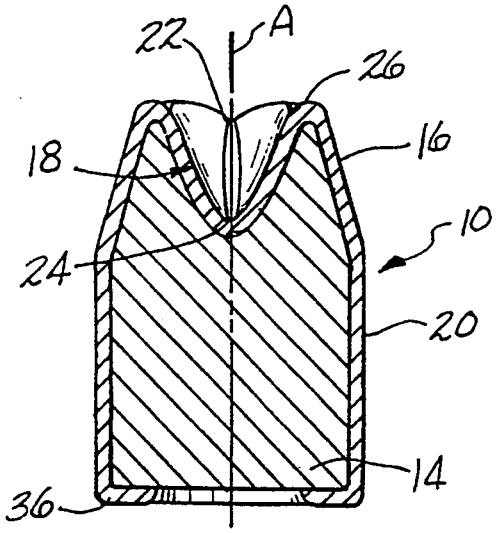
FIG. 3 is a longitudinal cross sectional view of the bullet of the invention taken along the line 3—3 in FIG. 2.

A first embodiment of a full metal jacket hollow point bullet 10 constructed in accordance with the invention is shown loaded into a cartridge case 12 in FIG. 1 and separately in FIGS. 2 and 3.

Bullet 10 has a generally cylindrical core body portion 14, a generally ogival front end portion 16, and a hollow open recess or cavity 18 axially extending into the front end portion 16. The core portions 14 and 16 are preferably formed of a malleable metal such as lead or a lead alloy.

A full metal jacket 20 covers at least a major portion of the cylindrical core body portion 14, all of the ogival front end portion 16 and extends fully into the hollow open cavity 18 so as to enclose the front end portion 16. The jacket is made of a malleable metal such as a copper or copper alloy.

A plurality of radial slits 22 in the jacket extend through the wall thickness of the full metal jacket 20 and extend axially from the apex 24 of the hollow open cavity 18 inside the cavity to the mouth 26 of the cavity. The portions of the jacket in the cavity 18 thus form pointed jacket prongs 28 between the slits 22 which converge at the apex 24 on the central axis A.

The front end portion 16 is preferably frustoconical in shape. The cavity 18 may have a curved profile or may have a generally conical profile having a straight sidewall. The choice depends on the caliber and the precision of the tooling necessary to form the cavity. Each prong 28 may be joined with the other prongs at the apex 24 or may be separated, again, depending on the precision of the tooling forming the slits in the jacketed core.

Figure 4:
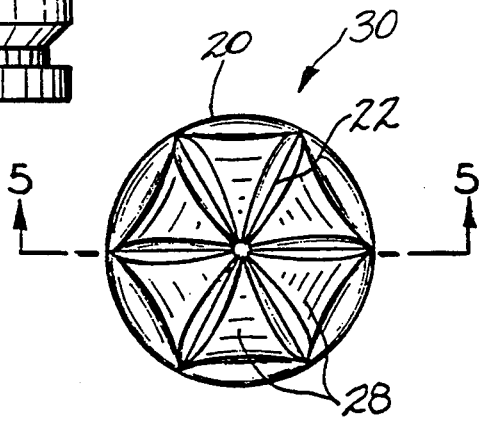
FIG. 4 is an end view of a jacketed bullet core prior to forming the ogival nose portion of the bullet shown in FIGS. 1 through 3.
Figure 5:
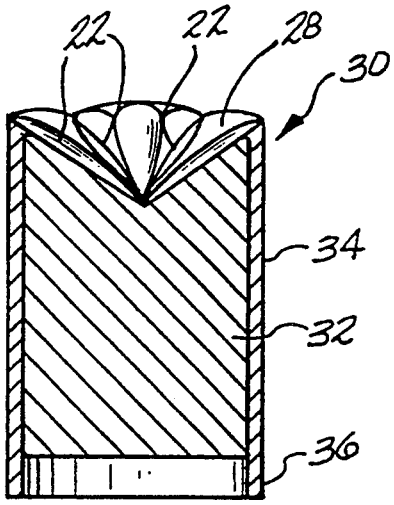
FIG. 5 is a longitudinal sectional view of the jacketed core taken along the line 5—5 in FIG. 4.

The bullet 10 is formed from a jacketed blank 30 shown in FIGS. 4 and 5. A cylindrical core blank 32 of lead is swaged or molded inside a flat bottomed cup shaped jacket blank 34 to form jacketed blank 30. A conical punch having radially spaced cutting ridges is then pressed against the flat bottom of the jacket blank 30 to form a curved or conical indent with radial slits 22 through the jacket 20 in the bottom of the blank 30. This indented blank is then forced into a conical cavity of a forming tool to constrict the bottom of the jacketed blank 30 to form the generally frustoconical front end portion 16 having the open cavity 18 with the converging prongs 28 as is shown in FIGS. 1 through 3. At the same time, the rear end 36 of the jacket blank 34 is crimped over the rear of the core blank 32 so as to securely capture and lock the core 14 within the jacket 20.

Thus the method of forming the full jacketed hollow point bullet 10 in accordance with the invention having an ogival front end portion 16 with a forwardly open cavity 18 therein comprises the steps of:

a) drawing a sheet metal blank into a cup shaped jacket blank 34 having a continuous flat bottom and a generally uniform thickness wall;

b) forming a malleable metal core 32 in the cup shaped jacket blank 34 against said bottom by swaging or molding the core directly into the blank;

c) indenting said bottom of said jacket blank;

d) cutting a plurality of radial slits 22 through the jacket wall in the indented bottom either separately or simultaneously with indenting the bottom; and e) forcing the end of the blank 30 containing the core against the indented bottom of the blank into a concave cavity of a forming tool to deform the end of the blank into an ogival front end portion 16 of the bullet 10 and the bottom into an open cavity 18 with the slits 22 through the jacket 20 remaining in the open cavity 18.

Finally, the rear end 36 of the blank 30 is crimped over the rear of the core 32 to lock it in place and ensure that the core 14 remains fully inserted within the front end of the jacket 20.

Figure 6:
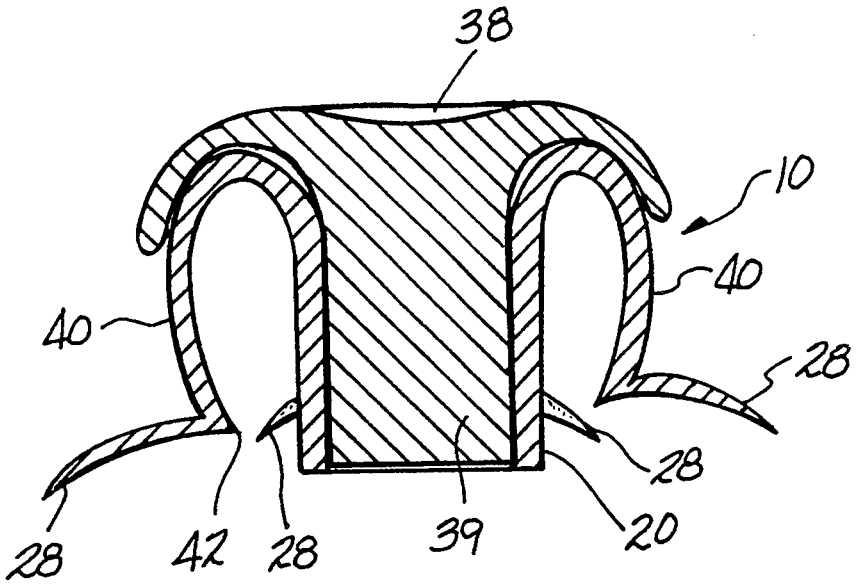
FIG. 6 is a sectional view of an upset bullet in accordance with the first embodiment of the invention.
Figure 7:
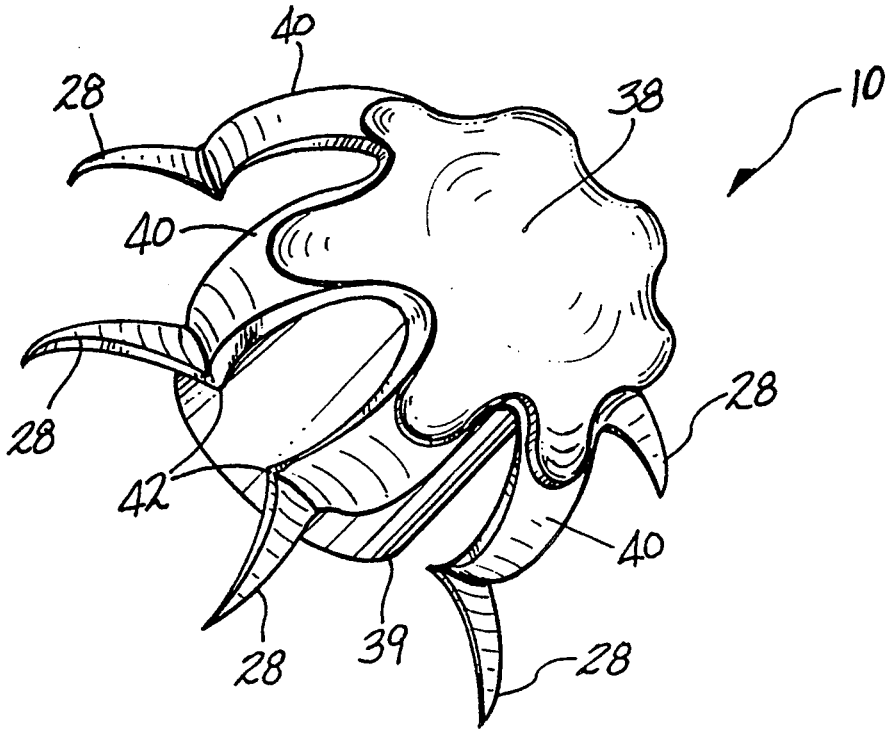
FIG. 7 is a perspective view of the upset bullet of the invention shown in FIG. 6.

FIGS. 6 through 7 illustrate the mushrooming of the bullet 10 of the invention and the unfolding of the prongs 28 when the first embodiment of the bullet of the invention is fired into soft body tissue. The upset bullet 10 forms a mushroomed head 38 in front of a generally cylindrical body portion 39 as the soft lead is forced forward and out during penetration and deceleration.

The prongs 28 separate radially as the head 38 forms causing the front end of the jacket to split and form petals 40 which are folded back. These petals 40 provide support for the prongs and cause them to extend outward from the folding petals 40. Each prong projects from a transition region 42 of the petal 40 corresponding originally to the jacket material at the mouth 26 of the cavity 18. This transition is a region of work hardened metal occurring because of the work hardening which takes place during constriction of indented end of the blank 30 to form the frustoconical front end portion 16.

The upset bullet 10 shown in FIGS. 6 and 7 results from penetration into soft body tissue. The soft body tissue is here simulated by penetration in gelatin. The angle and curvature at which the prongs 28 extend outward from the body portion upon upset will depend on several factors, such as projectile velocity and particular jacket alloy characteristics.

In the illustrated first embodiment, the jacket was draw formed from a cup shaped blank. The blank was made from gilding metal which is a brass alloy conforming to ASTM B36. The bullet core of lead alloy is swaged into the draw formed cup shaped blank. The 10 mm finished bullet was conventionally inserted into a 10 mm case loaded with 5.2 grains of Bullseye® No. 2 propellant powder (by Hercules Powder Co.).

Five test rounds were fired from a Colt model Delta Elite automatic pistol into a standard gelatin test module from a distance of about 10 feet at a velocity of about 950 feet per second. The gelatin test module was 6" by 6" by 18". The five resultant upset bullets retrieved from the test modules all exhibited the structure as shown in FIGS. 6 and 7.

A different result occurs when the bullet 10 is fired through barrier materials such as several layers of heavy clothing or deer hide prior to entering soft body tissue. Penetration through such barrier materials is desired by the FBI and other law enforcement agencies for defensive use by their officers. In this situation, the cavity in the nose of the first embodiment of the present invention is filled with barrier material as the impacting bullet punches through the barriers. The barrier material essentially eliminates the recess. The barrier material thus prevents expansion of the bullet when it then enters soft tissue.

It has been found, however, that a second embodiment of the invention, having an empty recess extension behind the forwardly open divergent portion of the recess compensates for this condition. This embodiment is shown in FIGS. 8 through 14. More particularly, this second preferred embodiment of the full metal jacket hollow point bullet 110, constructed in accordance with the invention, is shown loaded into a cartridge case 112 in FIG. 8 and separately in FIGS. 9 and 10.

As in the first embodiment, bullet 110 has a generally cylindrical core 114 which has a generally ogival front end portion 116 and a hollow open recess 118 axially extending into the front end portion 116. The core 114 is preferably formed of a malleable metal such as lead or a lead alloy.

A full metal jacket 120 covers at least a major portion of the cylindrical core 114, all of the ogival front end portion 116 and extends fully into a hollow divergent portion 121 of the recess 118 so as to cover the mouth 119 of the front end portion 116. The jacket 120 is made of a malleable metal such as a copper or copper alloy and is preferably about 95% copper and about 5% zinc.

The jacket 120 has a chemically deposited copper 200 oxide coating on its inner and outer surfaces produced by alkaline oxidation. The coating is produced by immersing the cups in a high temperature solution of potassium hydroxide and potassium chlorite. This coating process was developed and is applied by MBI Division of Hubert Hall, Inc. The 200 coating has a rough surface which, on the inside surface, frictionally bonds the core material to the jacket and thus minimizes lead wash during upset as is described in more detail below with reference to FIG. 14. The 200 coating on the outside surface is polished to remove the roughness and yield a smooth appearance.

A plurality of radial slits 122 in the jacket extend through the wall thickness of the jacket 120 and extend outwardly and axially from a generally circular base 124 of the divergent portion 121 of the recess 118 to the mouth 119 of the recess 118. The portions of the jacket in the recess 118 form spaced pointed jacket prongs 126 between the slits 122 which converge toward the central axis A'.

Extending rearwardly from the base 124 of the divergent portion 121 of the recess 118 is a coaxial, generally cylindrical extension portion 128 of the recess 118. The extension portion 128 terminates at a conical, curved or flat bottom 129. The jacket prongs 126 do not extend into this extension portion 128 so that the core 114 material is exposed to the recess extension 128.

The front end portion 116 is preferably frustoconical in shape as shown or curved in a smooth arc. The recess extension 128 preferably extends rearwardly to the base of the front end portion 116 but may extend a different amount depending on the desired mushrooming on upset.

The divergent portion 121 of the recess 118 may have a curved sidewall profile or may have a generally conical profile having a straight sidewall. The choice depends on the caliber, the upset performance desired and the precision of the tooling necessary to form the recess 118. On the other hand, the recess extension preferably has a cylindrical or slightly divergent shape which is primarily dictated by the extraction requirements of the forming tool.

Figure 11:
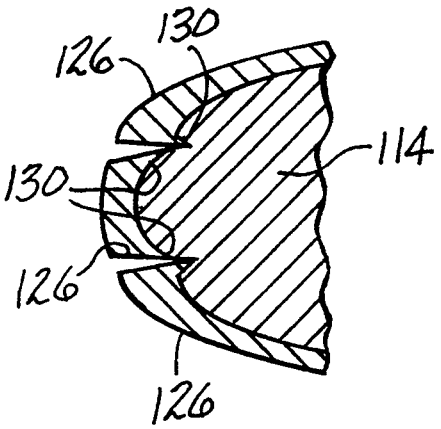
FIG. 11 is a partial longitudinal sectional view of the invention shown in FIG. 10 taken along the line 11—11.

Each prong 126 has a generally triangular shape and generally terminates in a point situated at or near the base 124 of the divergent portion of the recess 118. The prongs 126 are also preferably symmetrically spaced about the central axis A'. As is best shown in FIG. 11, each prong 126 has a reinforcing fillet 130 at each side of the end of the slit 122 forming the prong 126 at the mouth 119 of the recess 118. These fillets 130 restrain the rearward bending of the jacket material at the mouth 119 during bullet upset. The result is the formation of outwardly directed prongs 126 as in FIG. 14 upon upset in soft body tissue.

Figure 12:
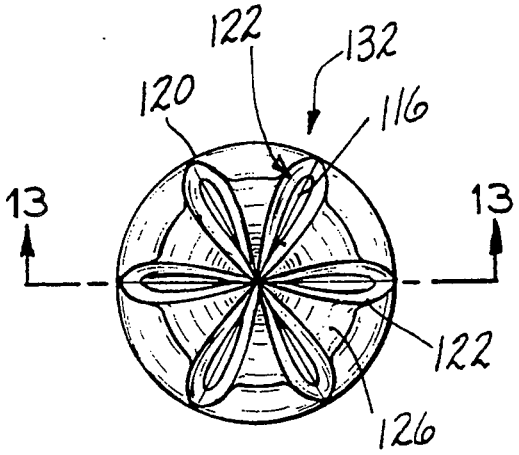
FIG. 12 is an end view of a jacketed bullet core prior to forming the ogival nose portion of the second embodiment shown in FIGS. 8 through 11.
Figure 13:
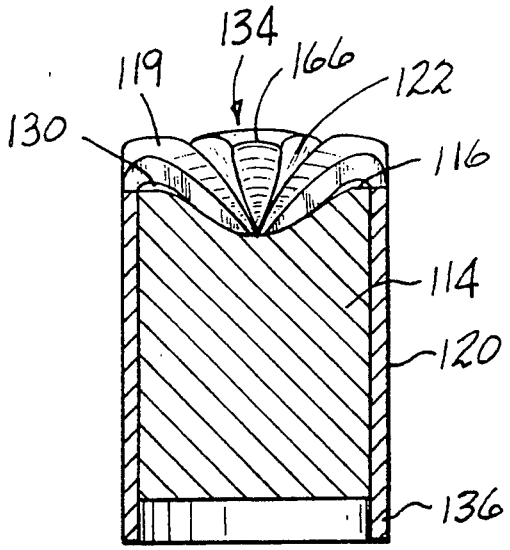
FIG. 13 is a longitudinal sectional view of the jacketed core taken along the line 13—13 in FIG. 12.

The bullet 110 is initially formed in a similar manner as described above for the first embodiment, from a jacketed blank 132 shown in FIGS. 12 and 13. However, in this case, the jacket cup is first coated as above described, with a rough copper oxide coating. In addition, the jacket cup may have a thickened sidewall and bottom so that a reverse taper interlock with the core is integrally formed during production.

The core 114 is inserted into the cup to form the blank 132. A forming tool is then pressed into the bottom of the blank 132 to form an inwardly curved bottom 134 and the radial slits 122. As in the first embodiment, the slits 122 pierce completely through the jacket 120 at the mouth 119 and into the front end portion of the core 114. In addition, slits 122 extend completely through the jacket from the mouth 119 to the central axis A so as to completely separate each prong 126 from one another. The included angle between the sides of the slit 122 is preferably sized by the forming tool to about 45° so as to optimize the reinforcing fillets 130 at the base of the prongs 126, i.e. extending between the prongs 126 and the jacket 120 at the mouth 119.

Figure 9:
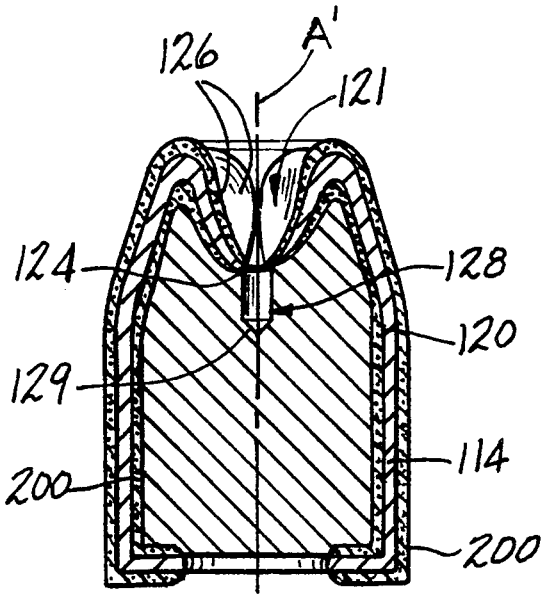
FIG. 9 is a longitudinal cross sectional view of the second embodiment of the bullet of the invention taken along the line 9—9 in FIG. 10.
Figure 8:
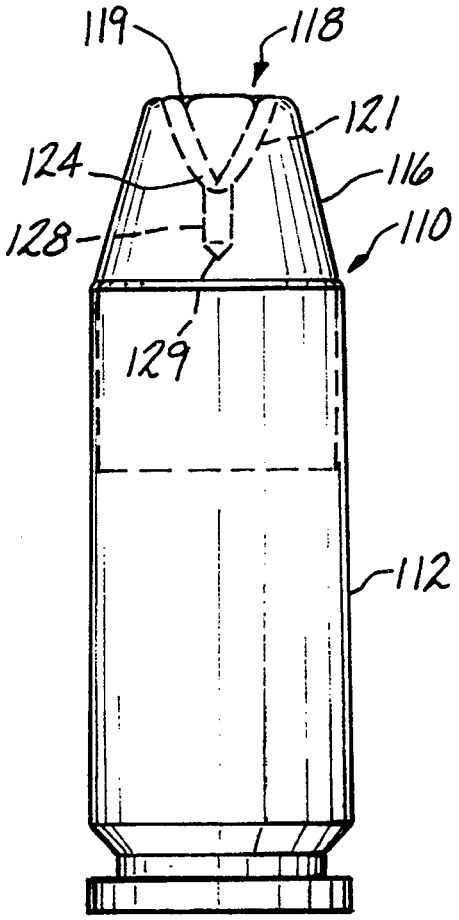
FIG. 8 is a side elevational view of a cartridge containing the bullet in accordance with a second preferred embodiment of the invention.
Figure 10:
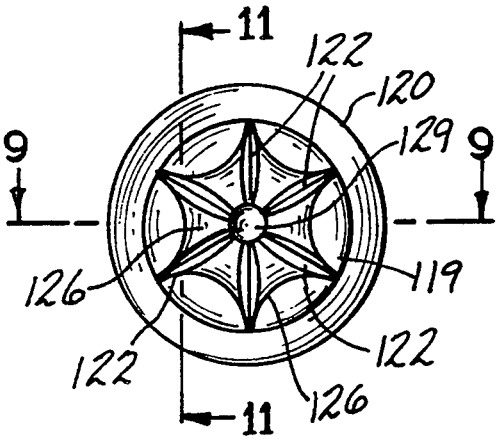
FIG. 10 is an end view of the bullet of the invention removed from the cartridge case in FIG. 8.

The blank 132 is then removed from the die and a second forming tool having a conical recess with a coaxial forming pin is lowered over the front end of the slit blank 132 shown in FIGS. 12 and 13. This forming tool squeezes the mouth 119 of the jacket 120 together to form the frustoconical or ogival nose of the bullet 110 as shown in FIGS. 8 through 10 and punches the recess extension 128 into the core 114 from the base 124 of the divergent portion 121. Simultaneously, this forming pin separates the points of the prongs 126 so that they are spaced about the axis A'.

As in the first embodiment, the squeezing of the front end portion 116 work hardens the jacket 120 at the mouth 119 to form a work hardened transition between the prongs 126 and the portion of the jacket 120 outside the recess 118. This hardened transition also includes the fillets 130. Thus the transition is doubly reinforced against bending that occurs upon upset.

The method of forming the full jacketed hollow point bullet 110 in accordance with this embodiment of the invention having an ogival front end portion 116 with a forwardly open recess 118 therein thus comprises the steps of:

a) drawing a sheet metal blank into a cup shaped jacket blank having a continuous flat bottom and a generally uniform thickness bottom wall;
b) coating the inside and outside surfaces of the blank with a copper oxide coating;
c) forming a malleable metal core 114 in the cup shaped jacket blank against said bottom by swaging or molding the core directly into the blank;
d) indenting said bottom of said jacket blank;
e) cutting a plurality of radial slits 122 through the jacket wall in the indented bottom 134 either separately or simultaneously with indenting the bottom;
f) forming a plurality of fillets in the jacket adjacent one end of the slits;
g) forcing the end of the blank 132 containing the core 114 against the indented bottom 134 of the blank into a concave cavity of a forming tool to deform the end of the blank into an ogival front end portion 116 of the bullet 110 and the bottom 134 into an open recess 118 with the slits 122 through the jacket 120 in a divergent portion of the recess 118; and
h) forming an empty recess extension 128 in the recess 118 rearward of the divergent portion 121. Finally, the rear end 136 of the blank 132 is crimped over the rear of the core 114 to lock it in place and ensure that the core 114 remains fully inserted within the jacket 120.

Figure 14:
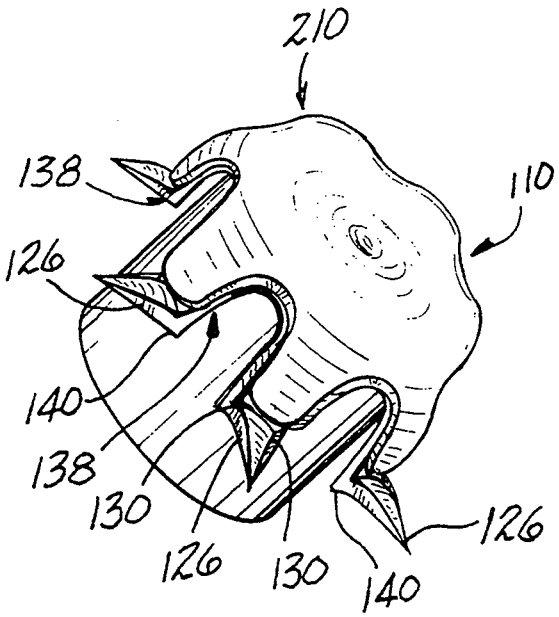
FIG. 14 is a perspective view of the upset bullet of the invention shown in FIGS. 8 through 11 following upset in simulated soft body tissue after penetration through several layers of fabric barrier material.

FIG. 14 illustrates the mushroomed head 210 of the second embodiment 110 of the invention and the unfolding of the prongs 126 when the bullet 110 is fired first through a composite barrier consisting of a layer of denim fabric, a down vest material layer, a flannel shirt and finally a cotton shirt and then into soft body tissue. Upset and mushrooming does not occur during barrier penetration.

As the hardened annular mouth 119 of the bullet 110 enters the barrier layers, the annular mouth 119 punches out a patch of the barrier materials. This patch fills the divergent portion of the recess 118. As the bullet exits the barrier material and passes into soft tissue, the forward resistance is reduced. This permits the inertia of the core 114 acting against the soft tissue to force the mouth 119 away from the bullet axis A' pushing the prongs 126 out of the recess as the nose expands which pushes the barrier material out, simultaneously causing the core material to spread out the nose of the bullet 110. This forces the prongs 126 to rotate outward as the core material forms the mushrooming head 210. However, the prongs 126 are prevented from folding rearwardly with the folding petals 138 because of the reinforcing fillets 130 at the hardened transition 140 corresponding to the mouth 119 above described.

Finally, the jacket has a reverse taper which tends to prevent forward movement of the core during upset. Also, the inside coating prevents the core from slipping forward in the jacked during mushrooming.

While the invention has been shown and described with reference to two preferred embodiments, other variations and modifications are contemplated as being within the scope of the invention. For example, the fillets 130 may be located other than at the end of the slit at the mouth 119. The fillet 130 may be located between the slits 122 by a suitably internally ribbed jacket 120. In this case the fillets would be preferably formed during the drawing of the jacket cup or blank prior to the insertion of the core 114, by use of a suitably notched bottom forming tool. Also, different jacket thicknesses and alloy compositions may be utilized and different numbers of slits may be cut in the jacket. In addition, the shape of the nose, the cavities or recesses 18 and 118, and the mouths 26 and 119 may be differently shaped which will change the amount of work hardening of the jacket at the region of the mouth and therefore the position of the transition region and shape of the prongs may be selectively varied. Accordingly it is intended to embrace all such variations and modifications as defined by the scope of the appended claims. All patents, patent applications and other references referred to herein are hereby incorporated by reference in their entirety.

What is claimed is:

1. An upset jacketed bullet, comprising:

a body generally symmetrical about a central axis having a mushroomed head; and a plurality of jacket petals folded back from said body behind said mushroomed head, each of said petals terminating in a generally radially outwardly pointing curved prong extending from a hardened transition region wherein each of said prongs has at least one fillet at said hardened transition region extending between said petal and said prong, said prongs defining a diameter larger than a diameter of said mushroomed head.

2. The upset bullet according to claim 1 wherein said jacket has an inside surface coating of an oxide bonding said body to said jacket.

3. The upset bullet of claim 2 wherein said jacket also has an outside surface coating of an oxide.

4. The upset bullet of claim 3 wherein said inside surface coating and said outside surface coating are copper oxide.

5. The bullet of claim 4 wherein the transition region has at least two reinforcing fillets extending between said petal and said prong.

6. The upset bullet of claim 1 wherein said petals are generally symmetrical about a central axis.

7. The upset bullet of claim 6 wherein said prongs are pointed.

* * * * *